US010752399B2

(12) United States Patent
Vandecasteele

(10) Patent No.: US 10,752,399 B2
(45) Date of Patent: Aug. 25, 2020

(54) BOX PALLET PROVIDED WITH A HINGED BOTTOM PANEL

(71) Applicant: DS SMITH DUCAPLAST, Wormhout (FR)

(72) Inventor: Benjamin Vandecasteele, Racquinghem (FR)

(73) Assignee: CORPLEX FRANCE WORMHOUT (FR)

( * ) Notice: Subject to any disclaimer, the term of this patent is extended or adjusted under 35 U.S.C. 154(b) by 0 days.

(21) Appl. No.: 16/342,801

(22) PCT Filed: Oct. 18, 2017

(86) PCT No.: PCT/EP2017/076631
§ 371 (c)(1),
(2) Date: Apr. 17, 2019

(87) PCT Pub. No.: WO2018/073316
PCT Pub. Date: Apr. 26, 2018

(65) Prior Publication Data

US 2019/0263559 A1 Aug. 29, 2019

(30) Foreign Application Priority Data

Oct. 18, 2016 (FR) ..... 16 60102

(51) Int. Cl.
*B65D 19/18* (2006.01)
*B65D 19/44* (2006.01)

(52) U.S. Cl.
CPC ..... *B65D 19/18* (2013.01); *B65D 19/44* (2013.01); *B65D 2519/009* (2013.01);
(Continued)

(58) Field of Classification Search
CPC ..... B65D 19/20; B65D 19/44; B65D 2519/00019
(Continued)

(56) References Cited

U.S. PATENT DOCUMENTS 2,534,011 A * 12/1950 Frye ..... B65D 5/3642 229/117.07
3,315,800 A * 4/1967 Wagner ..... B65D 19/44 206/597
(Continued)

FOREIGN PATENT DOCUMENTS

EP 1947019 A2 7/2008
EP 2193998 A1 6/2010
(Continued)

OTHER PUBLICATIONS

International Search Report and Written Opinion for PCT/EP2017/076631 dated Nov. 27, 2017. [English Translation Provided].

*Primary Examiner* — Jose V Chen
(74) *Attorney, Agent, or Firm* — Thomas Horstemeyer, LLP

(57) ABSTRACT

A box pallet (1) comprising at least one base (4) and an articulated belt (5), the box pallet (1) being convertible between a loading configuration in which the belt (5) is unfolded and erected on the base (4) so as to form a storage volume and an empty transport configuration in which the belt (5) is folded and laid flat on the base (4); characterised in that it comprises at least one articulated bottom panel (10) that bears on the base (4) and is capable of forming a wedge for a bulky object, such as a motor vehicle seat, that needs to be loaded into the storage volume.

9 Claims, 10 Drawing Sheets

(52) U.S. Cl.
CPC ..... *B65D 2519/00034* (2013.01); *B65D 2519/00069* (2013.01); *B65D 2519/0096* (2013.01); *B65D 2519/00174* (2013.01); *B65D 2519/00208* (2013.01); *B65D 2519/00338* (2013.01); *B65D 2519/00497* (2013.01); *B65D 2519/00517* (2013.01); *B65D 2519/00597* (2013.01); *B65D 2519/00641* (2013.01); *B65D 2519/00711* (2013.01); *B65D 2519/00815* (2013.01); *B65D 2519/00915* (2013.01); *B65D 2519/00965* (2013.01); *B65D 2519/00975* (2013.01); *B65D 2585/647* (2013.01); *B65D 2585/6882* (2013.01)

(58) Field of Classification Search
USPC ..... 108/55.1, 55.3, 55.5, 51.3
See application file for complete search history.

(56) References Cited

U.S. PATENT DOCUMENTS 3,472,363 A * 10/1969 Overton ..... B65D 85/66 206/597
4,085,847 A * 4/1978 Jacalone ..... B65D 19/20 108/51.3
4,090,659 A * 5/1978 Galmiche ..... B65D 19/06 108/51.3
4,717,025 A * 1/1988 Maurer ..... B65D 19/20 108/51.3
4,838,418 A * 6/1989 Teixeira ..... B65D 19/06 108/55.1
5,029,734 A * 7/1991 Nichols ..... B65D 19/06 108/55.3
5,517,927 A * 5/1996 Karpisek ..... B65D 19/12 108/55.1
5,722,328 A * 3/1998 Darby ..... B65D 19/06 108/53.1
5,934,474 A * 8/1999 Renninger ..... B65D 19/20 108/51.3
6,006,675 A * 12/1999 Heil ..... B65D 19/44 108/53.3
6,019,226 A * 2/2000 Zajdlik ..... B65D 19/16 108/55.1
6,041,718 A * 3/2000 Brandes ..... B65D 19/0012 108/51.3
6,286,792 B1 * 9/2001 Best ..... B65D 19/08 108/53.1
6,550,741 B1 * 4/2003 Cottone ..... B60P 7/12 108/51.11
6,581,769 B2 * 6/2003 Nist ..... B65D 19/20 108/51.11
6,832,562 B2 * 12/2004 Tabor ..... B65D 19/0028 108/51.3
7,971,733 B2 * 7/2011 Ponto ..... B65D 19/44 108/55.1
8,221,869 B2 * 7/2012 Pare ..... B65D 71/0096 108/51.3
8,256,615 B2 * 9/2012 Goda ..... B65D 19/06 108/55.1
8,256,621 B2 * 9/2012 Deiger ..... B65B 11/025 108/51.3
2007/0068427 A1 * 3/2007 Burke ..... A47F 1/126 108/55.3

FOREIGN PATENT DOCUMENTS

EP 2690027 A1 1/2014
JP 2015016872 A 1/2015
WO 03068616 A1 8/2003
WO 2012136706 A1 10/2012
WO 2015023519 A1 2/2015

* cited by examiner

BOX PALLET PROVIDED WITH A HINGED BOTTOM PANEL

CROSS-REFERENCE TO RELATED APPLICATIONS

This application is the 35 U.S.C. § 371 national stage application of PCT Application No. PCT/EP2017/076631, filed Oct. 18, 2017, where the PCT claims the priority to and benefit of French Patent Application No. 1660102, filed Oct. 18, 2016, both of which are herein incorporated by reference in their entireties.

TECHNICAL FIELD

The present invention relates to the field of box pallets, and more specifically box pallets intended for the transportation of bulky products, such as motor vehicle seats and/or bench seats.

STATE OF THE ART

A box pallet generally comprises a base forming a pallet to make it possible for the handling thereof, a belt and a cover. A box pallet is convertible between the loading configuration in which the belt is unfolded and erected on the base so as to form a storage volume and an empty transport configuration in which the belt is folded and laid flat on the base. Such a box pallet is, for example, presented in documents EP-A1-2,193,998 and EP-A1-2,690,027 in the name of the applicant.

To optimise, in particular, the storage and the transportation of box pallets, the latter can be stacked and, in other words, piled vertically on top of one another. Thus, the cover comprises, for example, several studs capable of being inserted into cavities of a complementary shape and formed in the base.

The dimensions of the box pallets are generally selected according to the transport means used and goods to be transported in order to maximise the loading and thus reduce the transport cost. Thus, for example, for a transportation by lorry, according to the goods to be transported, the user has different box pallet models each having dimensional characteristics adapted to the storage space defined by the trailer of the lorry, and namely for example, an optimised stack of two or three box pallets according to the model.

This standardisation however requests the user, for certain bulky objects to be transports such as motor vehicle seats and/or bench seats, to incline these objects in order to be adapted to the box pallet models proposed.

Currently, the user uses, for example, one or more wedges equipped with inclined planes in order to position and orient the object to be transported in the storage volume of the box pallet.

Such a loading is however not optimised.

First, these wedges are positioned manually and without visual markers on the base, upstream of the introduction of the object to be transported in the storage volume. Thus, the user must regularly have several attempts in order to correctly position and orient the object in the storage volume, at the expense of productivity.

Second, these bulky wedges are stored separately when the box pallets are converted from the loading configuration to the empty return configuration. Thus, it is essential that they are simultaneously brought back to the box pallets on the loading stations such that the loading chain is not immobilised.

Third, the wedges are simply returned onto the base of the box pallet. Thus, during transportation, under the shocks caused by the irregularities of the road, the objects can be moved, and in particular damage the locking means of the cover on the belt and/or the structure of the belt.

The prior art also comprises documents JP-A-2015016872, WO-A1-03/068,616, U.S. Pat. No. 3,472,363, EP-A2-1947019, WO-A1-2012/136,706, WO-A1-2015/023,519.

The aim of the present invention is therefore to propose a box pallet making it possible for an easy loading of the object to be transported, this box pallet also being convertible quickly and compact.

SUMMARY OF THE INVENTION

The invention proposes, to this end, a box pallet comprising at least one base and one articulated belt, the box pallet being convertible between a loading configuration in which the belt is unfolded and erected on the base so as to form a storage volume and an empty transport configuration in which the belt is folded and laid flat on the base;

characterised in that it comprises at least one articulated bottom panel which bears on the base and which is capable of forming a wedge for a bulky object, such as a motor vehicle seat, that needs to be loaded in the storage volume.

In the present application, by "erected belt", this means a belt which extends substantially perpendicularly to the base, for example, vertically, and by "belt laid flat" means a belt which extends substantially parallel to the base (i.e. to the plane of the base), for example horizontally.

First, during the loading, the operator has simply to deploy the panel upstream of the introduction of the bulky object to be transported in the storage volume, benefiting productivity and the loading simplicity.

Second, an articulated panel can easily be folded and laid flat with the belt between the base and the cover, when the box pallet is converted from a loading configuration to an empty transport configuration, benefiting the compactness.

Third, during the transportation, a panel makes it possible to guarantee the stability of the bulky object loaded in the storage volume.

The box pallet according to the invention can comprise one or more of the following characteristics, taken individually from one another or in combination with one another:

- the panel is articulated around a folding line substantially parallel to the base;
- the folding line is formed by local compression of the material and/or a thinning of the thickness of the panel;
- the panel comprises a tray and a flap articulated with the tray around a folding line substantially parallel to the base, this flap being mobile between a deployed position in which the flap is angularly deviated by a predetermined angle of the panel so as to form the wedge for the object and a retracted position in which the flap is parallel to the tray;
- the flap is housed in a reinforcement of the tray when it is located in the retracted position thereof;
- the panel comprises a sole articulated with the tray around a folding line substantially parallel to the base and opposite the flap, the sole abutting against a first plate of the belt and the flap abutting against a second plate of the belt when the flap is in a deployed position, the first plate being opposite the second plate;
- the panel comprises at least one mobile arm in rotation about an axis substantially parallel to the base;
- the box pallet comprises a cover;

the panel comprises at least one wedging wall articulated with respect to the tray or returned on the tray;

the panel comprises means for holding the flap and/or the sole and/or the wedging wall;

the panel comprises at least one elastic connection capable of immobilising the object on the panel.

DESCRIPTION OF THE FIGURES

The invention will be best understood and other details, characteristics and advantages of the invention will appear more clearly upon reading the following description made as a non-limiting example and in reference to the appended drawings, in which.

DETAILED DESCRIPTION

Figure 1:
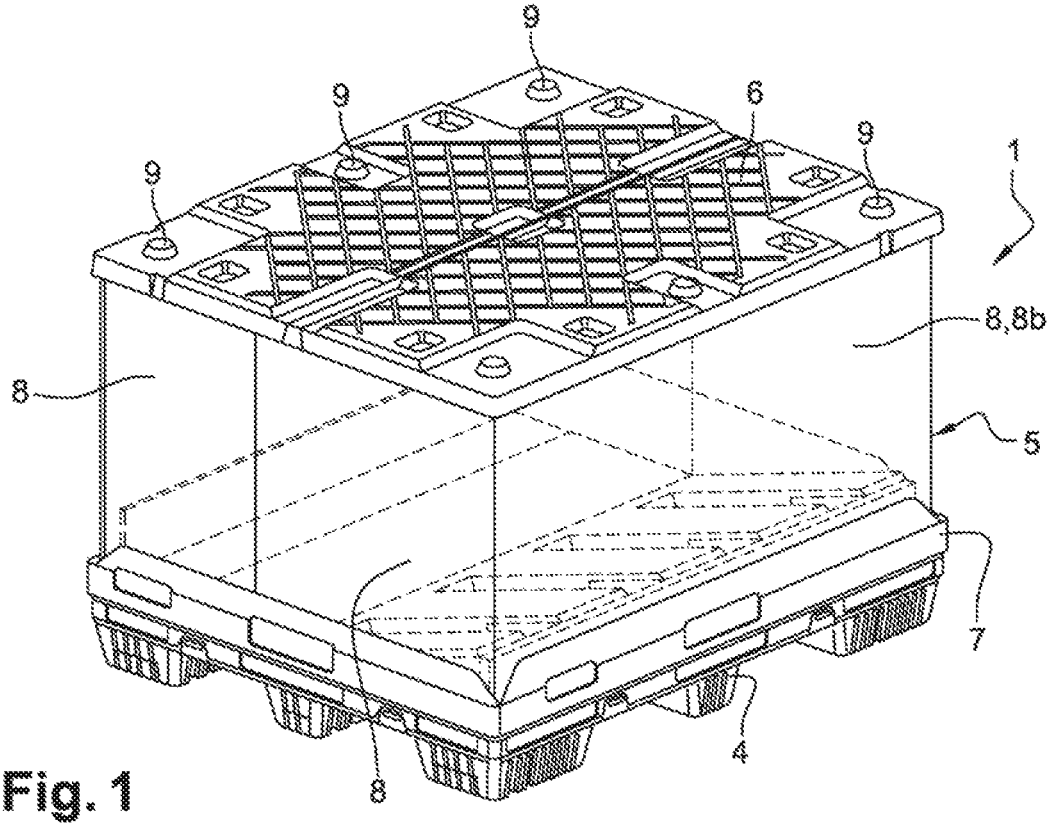
FIG. 1 is a perspective view of a box pallet in a loading configuration.
Figure 5:
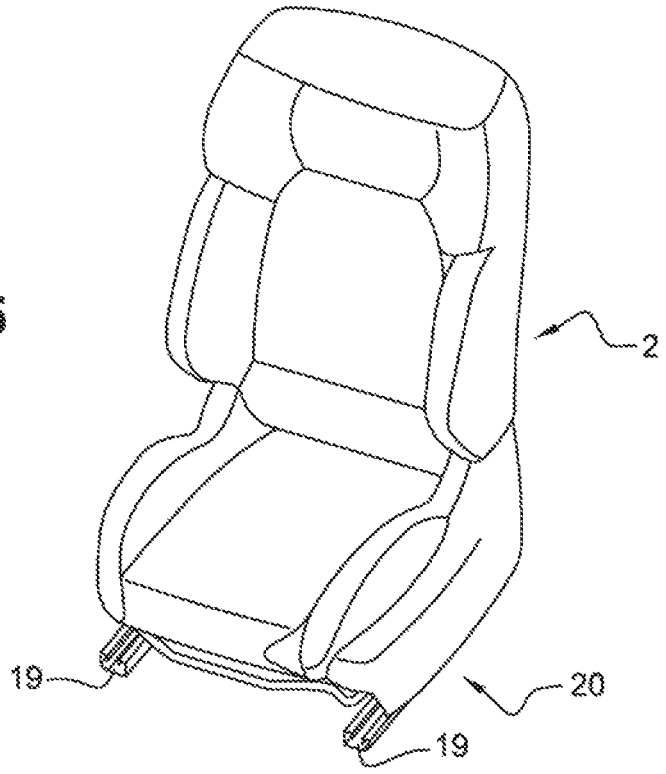
FIG. 5 is a perspective view of a motor vehicle seat capable of being loaded in the box pallet.
Figure 6:
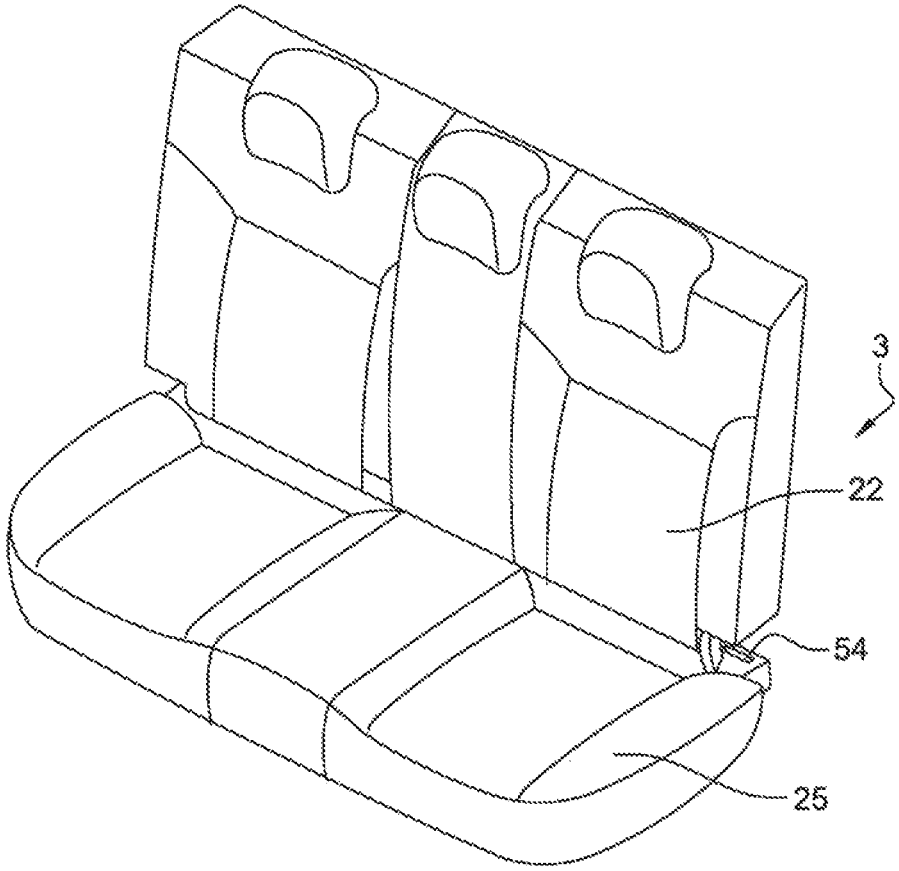
FIG. 6 is a perspective view of a motor vehicle bench seat capable of being loaded in the box pallet.

In FIG. 1, a box pallet 1 is represented capable of storing at least one bulky object, and according to the example illustrated, two contiguous front seats 2 (FIG. 5) and a rear bench seat 3 (FIG. 6) of a motor vehicle.

Figure 2:
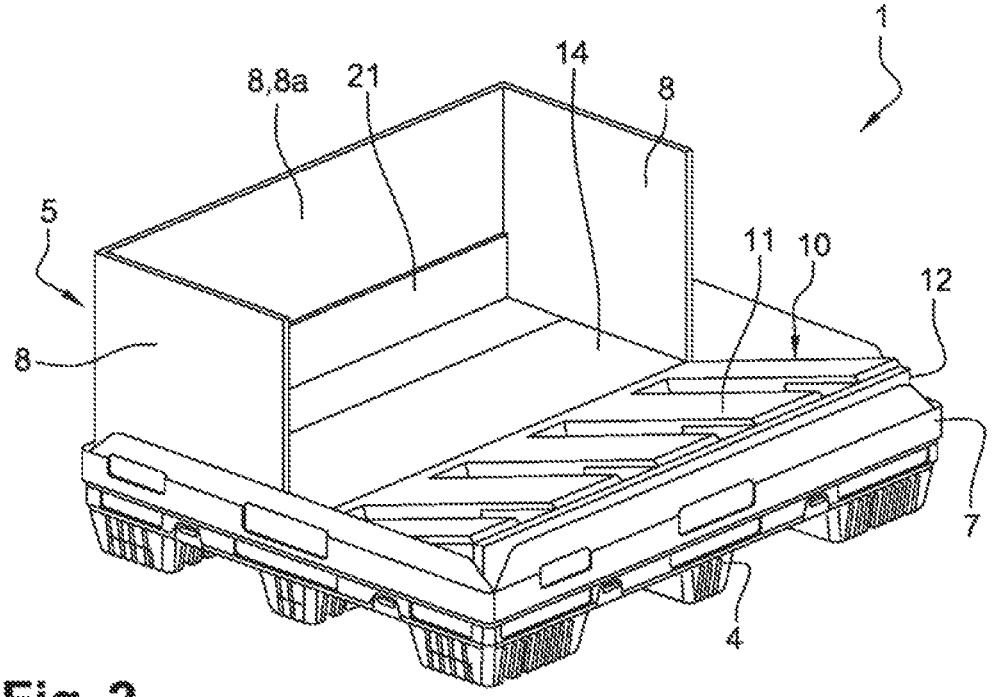
FIG. 2 is a perspective, partial view of the box pallet represented in FIG. 1.
Figure 3:
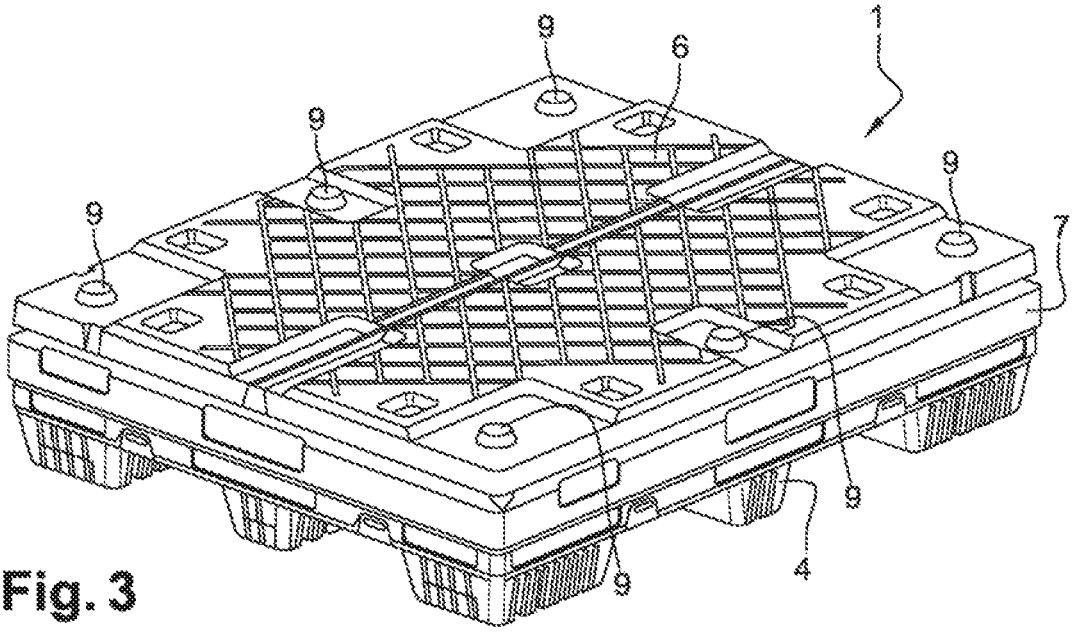
FIG. 3 is a perspective view of the box pallet in an empty return configuration.

The box pallet 1 comprises at least one base 4 forming a pallet and an articulated belt 5, the box pallet 1 being convertible between a loading configuration (illustrated in FIGS. 1 and 2) in which the belt 5 is unfolded and erected on the base 4 so as to form a storage volume and an empty transport configuration (illustrated in FIG. 3) in which the belt 5 is folded and laid flat on the base 4.

By convention in the present application, the following directions are defined with respect to the box pallet 1:

a longitudinal, horizontal direction, combined with the length of the base 4, a transversal, horizontal direction, combined with the width of the base 4, a vertical direction, combined with the height of the base 4.

According to the embodiment illustrated in the figures, the box pallet 1 further comprises a cover 6 covering, in particular, the storage volume in a loading configuration and a collar 7 surrounding the belt 5 when the box pallet 1 is in a loading configuration, this collar 7 being secured to the base 4. The collar 7 is obtained, for example, by folding a bubble structure polypropylene plate commercialised under the brand Akyboard® or a honeycomb polypropylene plate commercialised under the brand Akylux® or by double skin thermoforming.

In the loading configuration illustrated, in particular, in FIG. 1, the belt 5 is secured to the base 4 and to the cover 6 by way of locking means housed respectively in the base 4 and the cover 6. In the empty return configuration illustrated, in particular, in FIG. 3, the cover 6 is secured to the collar 7 by way of the locking means of the cover 6. Such locking means are in particular presented in more detail in document EP-A1-2,193,998 in the name of the applicant.

According to the embodiment illustrated in the figures, the belt 5 is formed of plates 8 articulated about vertical folding axes, and in other words, perpendicular to the base 4 when the box pallet 1 is in a loading configuration. The belt 5 corresponds to a belt 5 which can be folded in an M-shape, similarly to the shape of the belt 5 during the folding (respectively deployment) of the latter. The belt 5 is obtained for example by folding a bubble structure polypropylene plate commercialised under the brand Akyboard® or a honeycomb polypropylene plate commercialised under the brand Akylux®. The belt 5 is only represented partially in FIG. 2.

Figure 4:
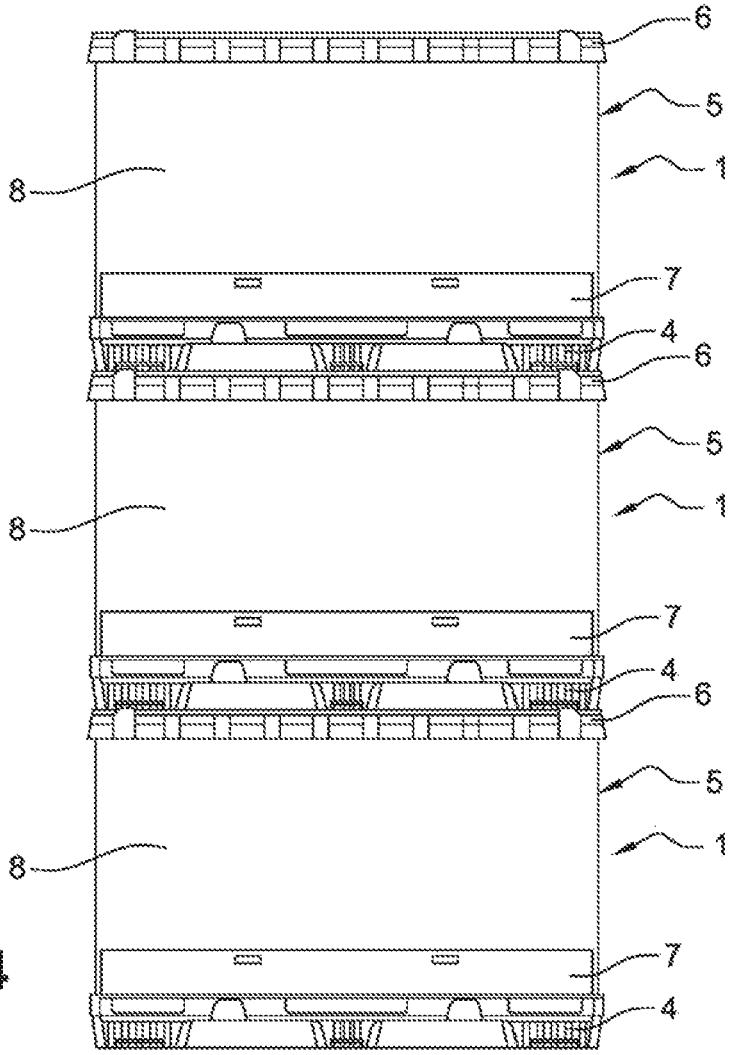
FIG. 4 is a front view of three stacked box pallets.

According to the embodiment illustrated in the figures, to make it possible to stack the box pallets (FIG. 4), and in other words, to stack them vertically on top of one another, the cover 6 comprises six studs 9 capable of being inserted into cavities of complementary shape and formed in the base 4. The cover 6 and the base 4 are, for example, obtained by double skin thermoforming.

Such a box pallet 1 is, for example, commercialised under the brand Uni-Pak®.

Advantageously, to minimise the mass thereof, the different components of the box pallet 1 are made of plastic material, and for example, made of polypropylene or made of polyethylene.

The box pallet 1 also comprises an articulated bottom panel 10 that bears on the base 4 and which is capable of forming a wedge for two longitudinally contiguous motor vehicle seats 2 that need to be loaded in the storage volume.

More specifically, the panel 10 comprises a tray 11 and an articulated flap 12 with the tray 11 around a first folding line 13 (longitudinal) substantially parallel to the base 4, this flap 12 being mobile between a deployed position (FIGS. 1, 2, 7, 8, 10 to 14, 17, 21 and 22) in which the flap 12 is angularly deviated by a predetermined angle A of the panel 10 so as to form the wedge for the two seats 2 and a retracted position (FIGS. 3, 9, 15 and 16) in which the flap 12 is parallel to the tray 11. A folding line thus forms a hinge or an articulation.

In other words, in a deployed position, the panel 10 makes it possible to wedge the two seats 2 in an inclined manner, such that the latter are comprised in the storage volume.

Thus, when the box pallet 1 is in loading configuration (FIGS. 1 and 2), the panel 10 bears on the base 4 in a deployed position in the storage volume. Conversely, when the box pallet 1 is in empty return configuration (FIG. 3), the panel 10 bears on the base 4 in a retracted position below the folded belt 5, and more mainly within the volume defined by the collar 7 between the base 4 and the cover 6.

Advantageously, to minimise the mass thereof, the panel 10 is made of plastic material, and for example, made of polypropylene or made of polyethylene.

According to the embodiments illustrated in the figures, in a deployed position, the flap 12 is angularly deviated from the tray 11 by a predetermined angle A such that the angle B between the tray 11 and the base 4 is comprised between 15° and 25°.

According to the embodiments illustrated in the figures, the panel 10 further comprises an articulated sole 14 with the tray 11 around a second folding line 15 (longitudinal) parallel to the first folding line 13 and opposite the flap 12, the sole 14 forming a support for the rear bench seat 3.

The first and second folding lines 13, 15 are formed by local compression of the material and/or a thinning of the thickness of the panel 10.

In a variant, not represented, the first and second folding lines 13, 15 are formed by one or more hinges.

Below in the description, different embodiments of the panel 10 are presented, the common elements between these embodiments have the same numbering.

According to the first embodiment of the panel 10 illustrated in FIGS. 7 to 10, when the flap 12 is in a deployed position (FIGS. 7, 8 and 10), the flap 12 is substantially perpendicular to the base 4 and forms a support of the tray 11. When the flap 12 is in a retracted position (FIG. 9), the flap 12 is housed in a reinforcement 16 of the tray 11 of complementary shape, this architecture makes it possible, in particular, to minimise the height of the box pallet 1 when the latter is located in empty return configuration.

In order to facilitate the positioning of the panel 10 on the base 4 and to prevent any transversal movement of the panel 10 in transport, the sole 14 can be abutted against a first plate 8*a* (longitudinal) of the belt 5 and the flap 12 can be abutted against a second plate 8*b* (longitudinal) of the belt 5 when the flap 12 is in a deployed position (FIGS. 7, 8 and 10), the first plate 8*a* being opposite the second plate 8*b*.

The tray 11 further comprises four transversal grooves 17, groups in pairs, each of these grooves 17 opening into the reinforcement 16 in the proximity of the first folding line 13 and being delimited by a bearing face 18 in the proximity of the second folding line 15. The grooves 17 are capable of each receiving a slide 19 of a device 20 for adjusting a front seat 2, these slides 19 being capable of being secured to a floor of a motor vehicle body. When the seat 2 is positioned on the tray 11, the slides 19 are abutted against the bearing faces 18 of the grooves 17.

The panel 10 further comprises a wall 21 for wedging a backrest 22 of the rear bench seat 3, this wall 21 being articulated with the sole 14 around a third folding line 23 (longitudinal) substantially parallel to the first and second folding lines 13, 15.

Figure 7:
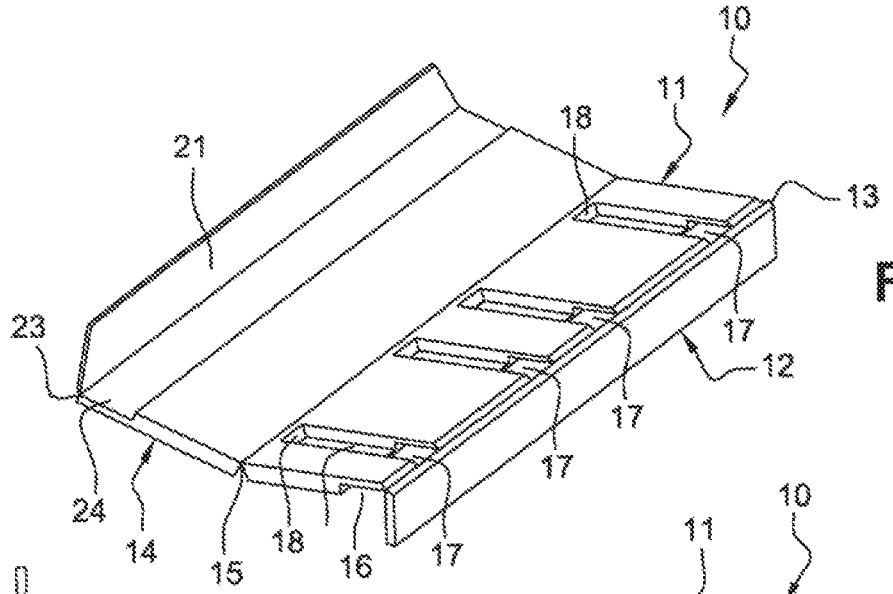
FIGS. 7 to 9 are views illustrating an articulated panel capable of forming a wedge for an object to be transported, according to a first embodiment.
Figure 8:
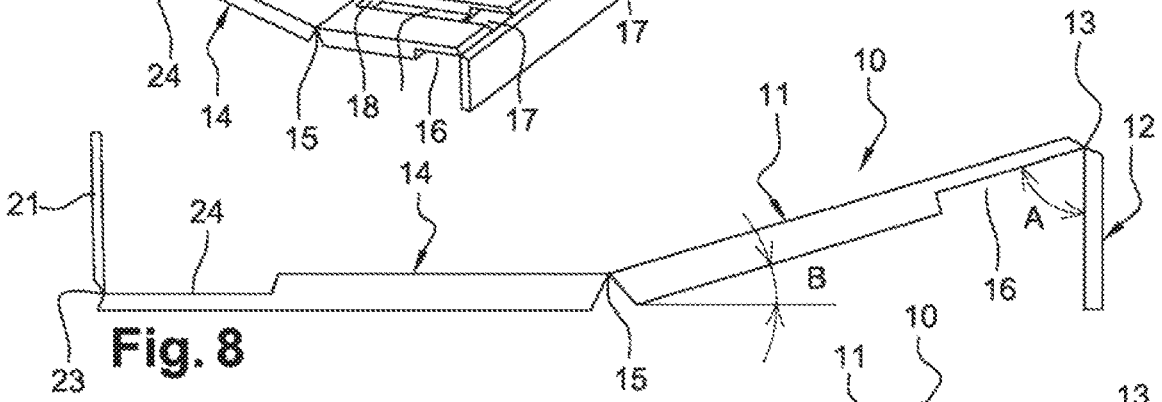
Figure 9:
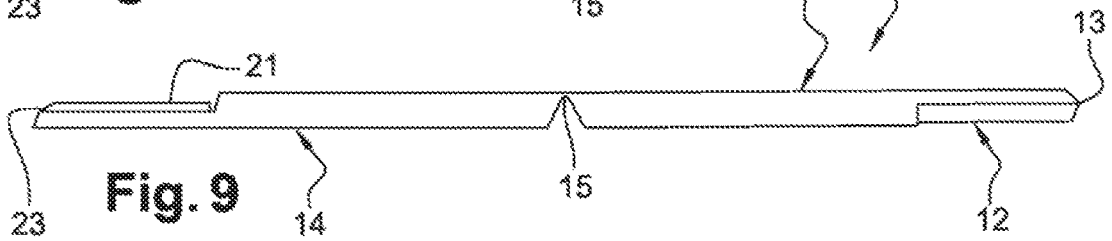
Figure 10:
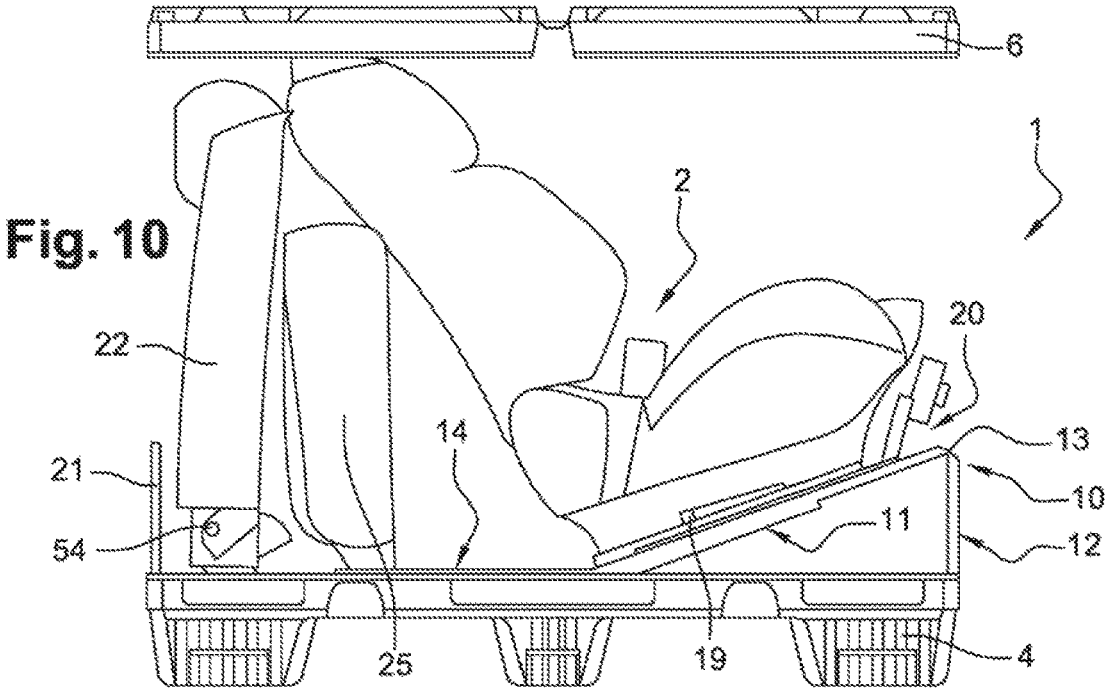
FIG. 10 is a front view illustrating the loading in the box pallet of two coupled seats represented in FIG. 5 and a bench seat represented in FIG. 6, by means of a panel represented in FIGS. 7 to 9.

When the box pallet 1 is in loading configuration, the wall 21 is angularly deviated by a predetermined angle (and in this case, substantially 90° according to the illustrated example) and held in position by the holding means (not represented), this wall 21 making it possible to longitudinally wedge the backrest 22 of the rear bench seat 3 (FIGS. 7, 8 and 10).

When the box pallet 1 is in empty return configuration, the wall 21 is housed in an indentation 24 of the sole 14 of complementary shape (FIG. 9), this architecture makes it possible, in particular, to minimise the height of the box pallet 1 when the latter is located in an empty return configuration.

Such as illustrated in FIG. 10, the backrest 22 extends longitudinally in the indentation 24 of the sole 14 such that it is substantially perpendicular to the sole 14. A base 25 of the rear bench seat 3 is inserted between the backrest 22 of the rear bench seat 3 and the front seats 2, the base 25 extending longitudinally such that it is substantially perpendicular to the sole 14.

The panel 10 is for example obtained, made of high-density polyethylene by double skin thermoforming.

Figure 11:
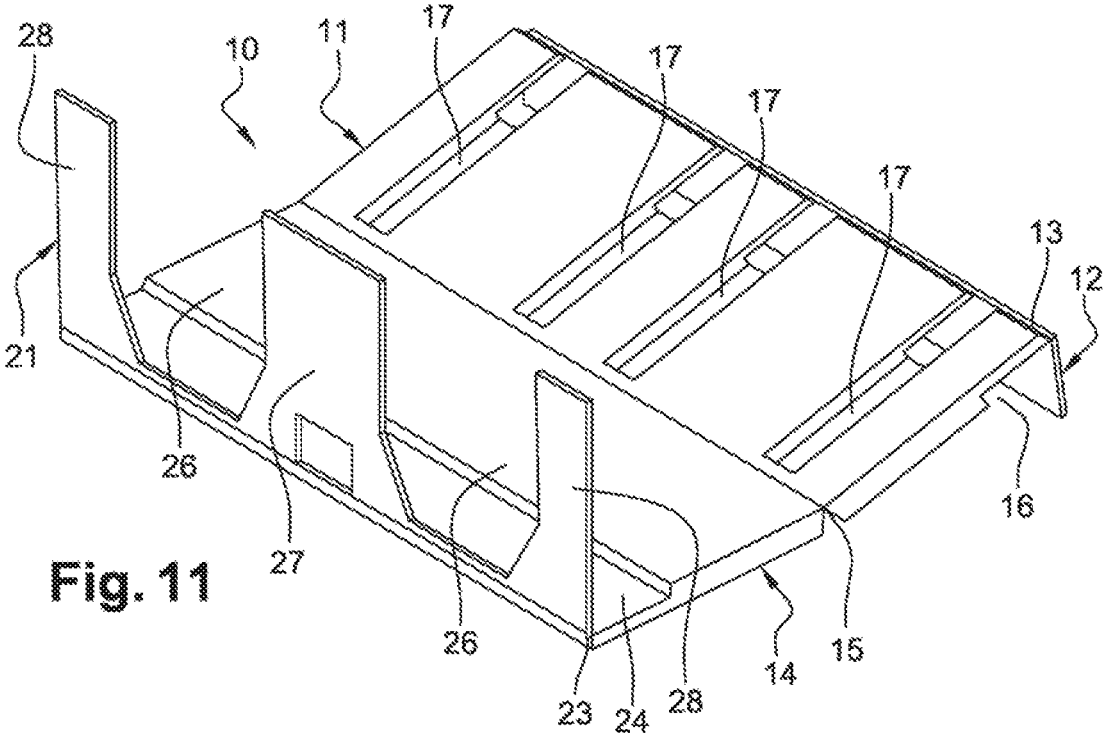
FIG. 11 is a variant of the panel illustrated in FIGS. 7 to 9.

According to a variant of the first embodiment illustrated in FIG. 11, in order to limit the mass of the wedging wall 21, the latter comprises two cuts 26 in order to form a central blade 27 placed between two side blades 28 bordering the wall 21.

Figure 12:
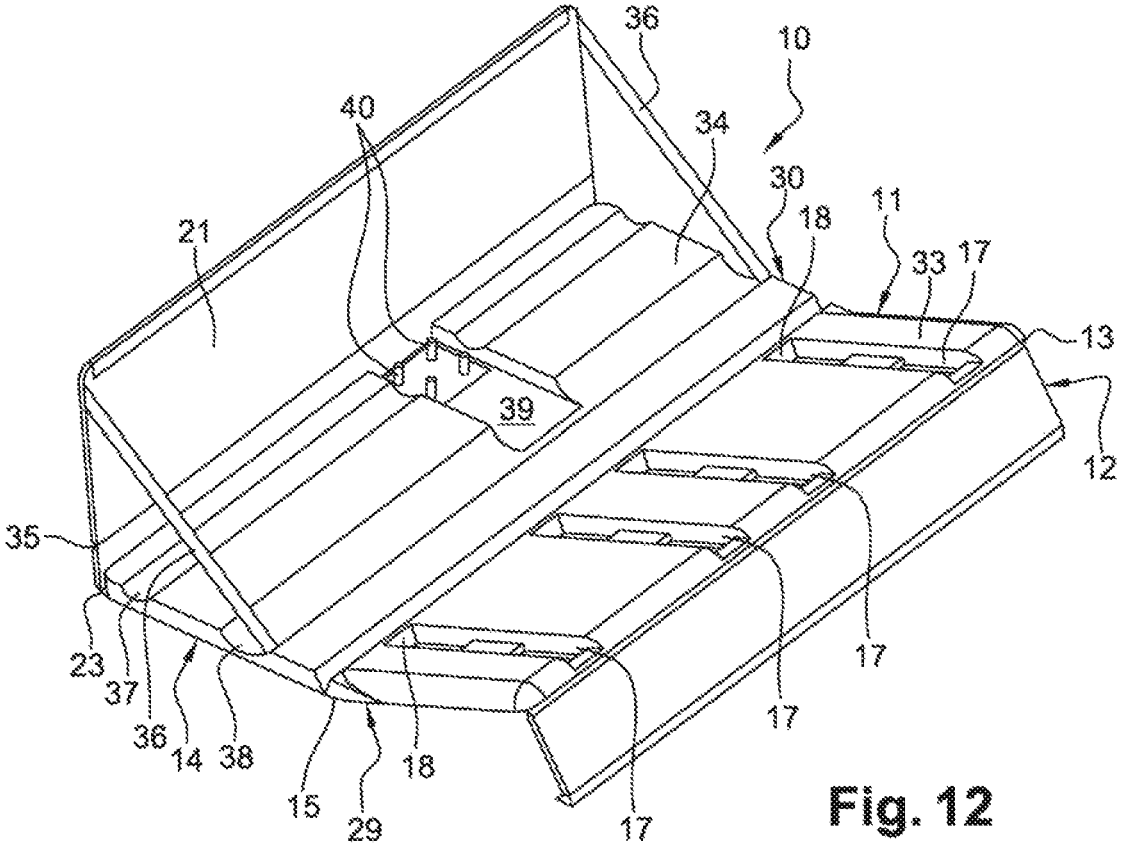
FIGS. 12 to 13 are views illustrating an articulated panel capable of forming a wedge for an object to be transported, according to a second embodiment.
Figure 13:
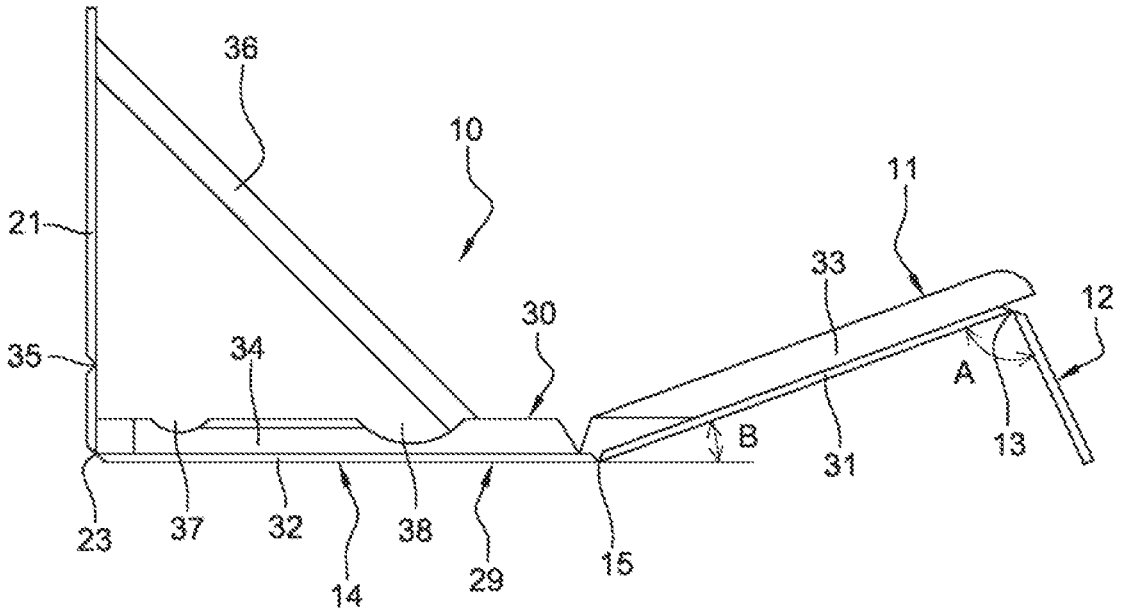

According to the second embodiment of the panel 10 illustrated in FIGS. 12 and 13, the panel 10 comprises a base 29 on which a shelf 30 is rested.

More specifically, the base 29 forms the flap 12, a lower portion 31 of the tray 11, a lower portion 32 of the sole 14 and the wedging wall 21. The first, second and third folding lines 13, 15, 23 are produced in the base 29. The shelf 30 forms an upper portion 33 of the tray 11 and an upper portion 34 of the sole 14.

When the flap 12 is in a deployed position (FIGS. 12 and 13), the sole 14 is abutted against a first plate 8*a* (longitudinal) of the belt 5 and the flap 12 is abutted against a second plate 8*b* (longitudinal) of the belt 5, the first plate 8*a* being opposite the second plate 8*b*.

When the flap 12 is in a retracted position, the latter is placed under the lower portion 31 of the tray 11.

The wall 21 comprises a fourth folding line 35 situated just under the third folding line 23, this fourth folding line 35 making it possible to fold an upper portion of the wall 21 on the upper portion 34 of the sole 14, when the box pallet 1 is converted from a loading configuration to an empty transport configuration. The means 36 for holding the wall 21, when the box pallet 1 is in loading configuration, are for example shrouds longitudinally bordering the panel 10, each shroud being secured to the upper portion of the wall 21 and to the upper portion 34 of the sole 14.

The upper portion 33 of the tray 11 comprises the grooves 17 capable of receiving slides 19 of devices 20 for adjusting front seats 2. The upper portion 34 of the sole 14 comprises two longitudinal gutters 37, 38, namely a first gutter 37 and a second gutter 38 respectively capable of receiving the backrest 22 and the base 25 of the rear bench seat 3. The upper portion 34 of the sole 14 further comprises a transversal passage 39 passing through the first gutter 37 and a portion of the second gutter 38, this passage 39 comprising four pins 40 vertically protruding, capable of receiving tabs for securing the backrest 22.

The base 29 is, for example, obtained by folding a bubble structure polypropylene plate commercialised under the brand Akyboard® or a honeycomb polypropylene plate commercialised under the brand Akylux®. The shelf 30 is, for example, obtained made of high-density polyethylene, by single skin thermoforming.

Figure 14:
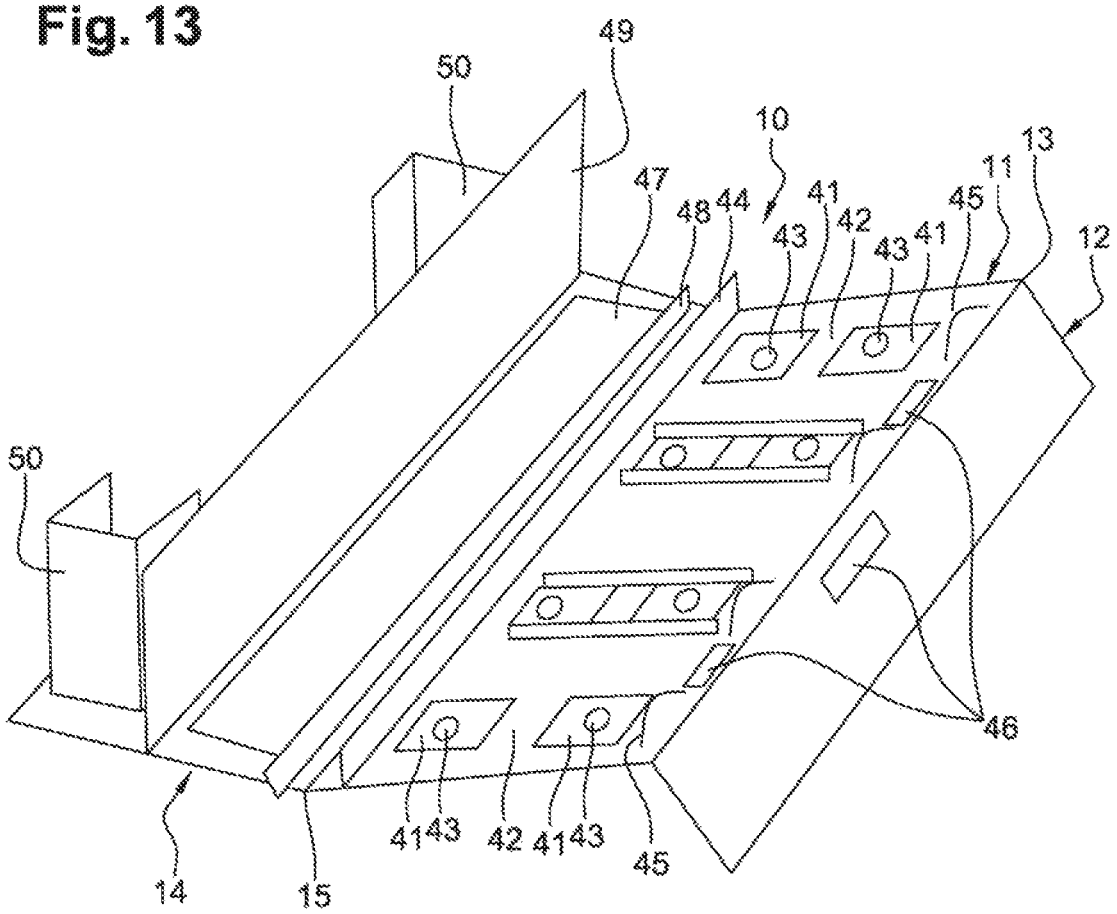
FIG. 14 is a schematic view illustrating an articulated panel capable of forming a wedge for an object to be transported, according to a third embodiment.
Figure 15:
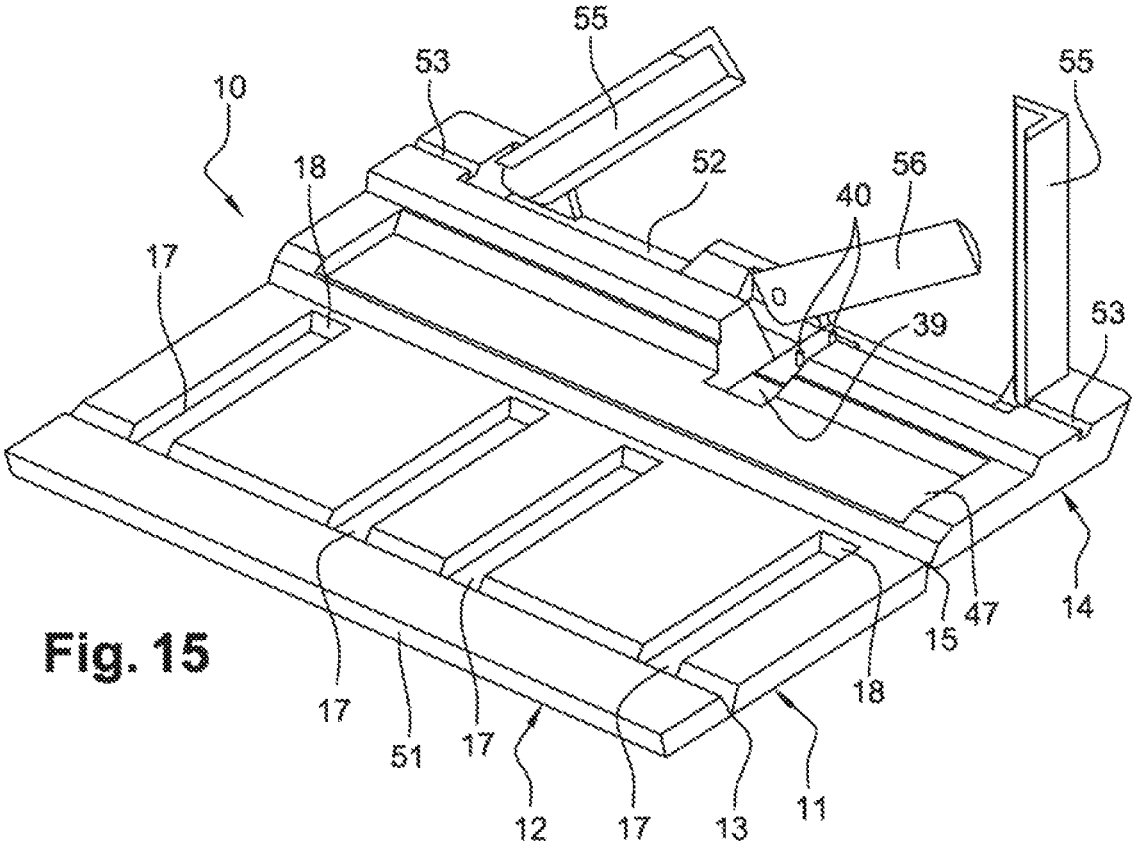
FIGS. 15 to 17 are views illustrating an articulated panel capable of forming a wedge for an object to be transported according to a fourth embodiment.
Figure 16:
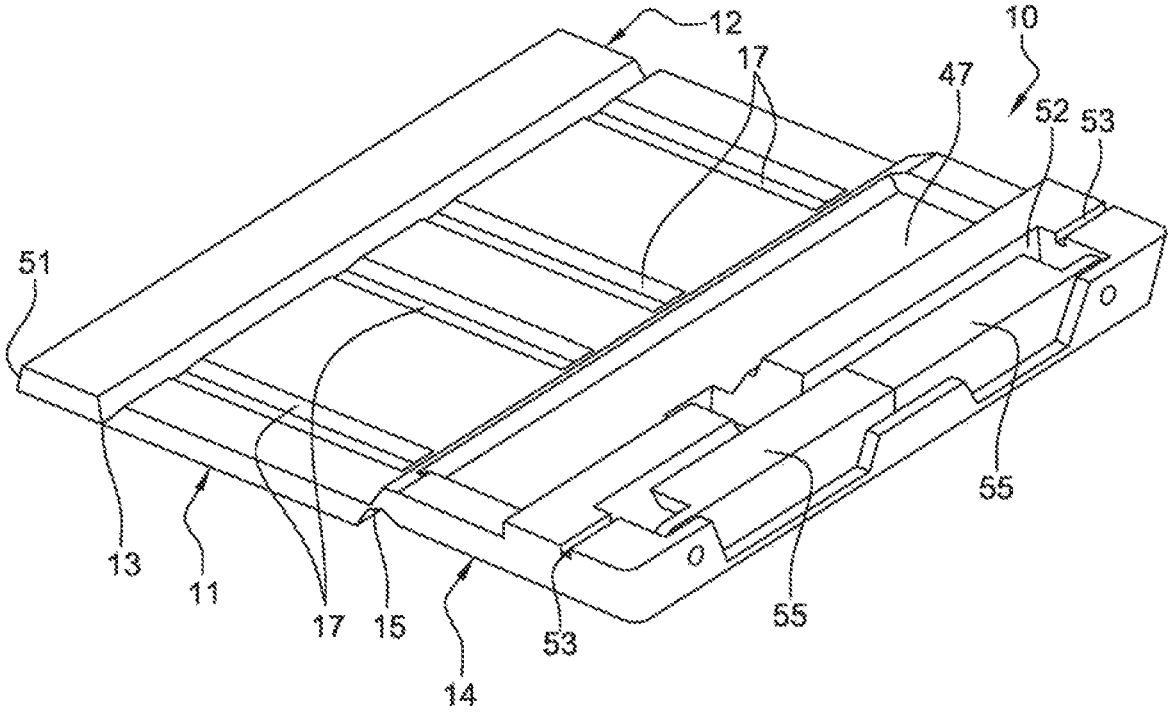
Figure 17:
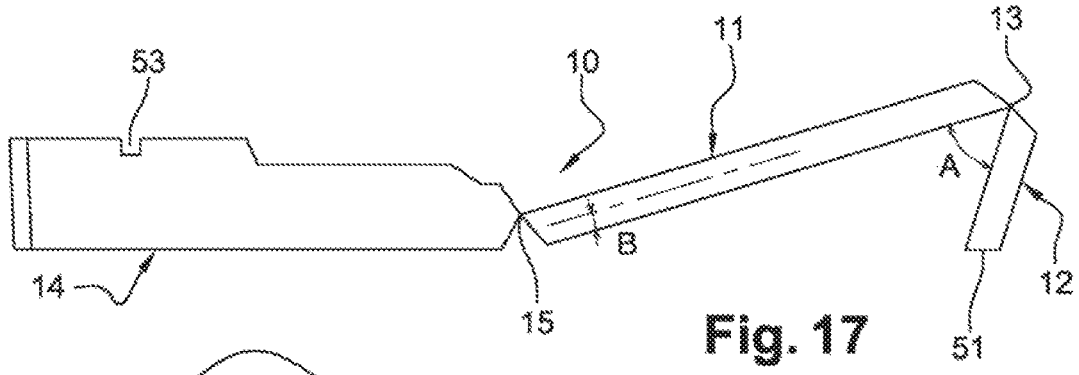

According to the third embodiment of the panel 10 illustrated in FIG. 14, when the flap 12 is in a deployed position (FIG. 14), the sole 14 is abutted against a first plate 8*a* (longitudinal) of the belt 5 and the flap 12 is abutted against a second plate 8*b* (longitudinal) of the belt 5, the first plate 8*a* being opposite the second plate 8*b*.

The tray 11 comprises, for each slide 19 of the adjustment device 20, two dents 41 separated by a bearing zone 42 of the slide 19 and each comprising a central opening 43 capable of being passed through by a means for blocking (not represented) the slide 19. The tray 11 comprises a first wall 44 for wedging the slides 19 of the adjustment devices 20, this first wall 44 being situated in the proximity of the second folding line 15 and for example, returned on the tray 11. The tray 11 also comprises means 45 for immobilising the slides 19 on the tray 11, these immobilisation means 45 being presented for example in the form of elastic elements.

The flap 12 and the tray 11 comprise gripping means 46 being presented, for example, in the form of rectangular windows in order to facilitate the passage of the flap 12 from a deployed position to a retracted position, and vice versa.

The sole 14 comprises a longitudinal cavity 47 in the proximity of the second folding line 15 and bordered transversally by two wedging walls 48, 49 of the base 25 of the rear bench seat 3, namely a second wall 48 and a third wall 49, for example returned on the sole 14. The sole 14 further comprises two U-shaped arms 50 and facing one another, these arms 50 being foldable about (transversal) axes parallel to the base 4 and capable of immobilising the backrest 22 by integrating the latter between the wings of each arm 50, when the box pallet 1 is in loading configuration (FIG. 14). The sole 14 also comprises pins (not represented), vertically protruding, capable of receiving the tabs for securing the backrest 22.

In empty transport configuration, the flap 12 is placed under the tray 11, the first, second and third walls 44, 48, 49 are laid flat on the panel 10 and the arms 50 are folded.

The panel 10 and the arms 50 are, for example, obtained separately by double skin thermoforming, the arms 50 then being returned on the sole 14. In a variant, the arms 50 can be obtained by cutting then folding a plastic plate.

According to the fourth embodiment of the panel 10 illustrated in FIGS. 15 to 20, the flap 12 of the panel 10 is chamfered such that in a deployed position (FIG. 17), the flap 12 is positioned under the tray 11 and forms a support of the tray 11, the dimensional characteristics of the flap 12 and of the chamfer 51 being determined to guarantee the stability of the tray 11. In a retracted position (FIGS. 15 and 16), the flap 12 is substantially coplanar with the tray 11.

Figure 18:
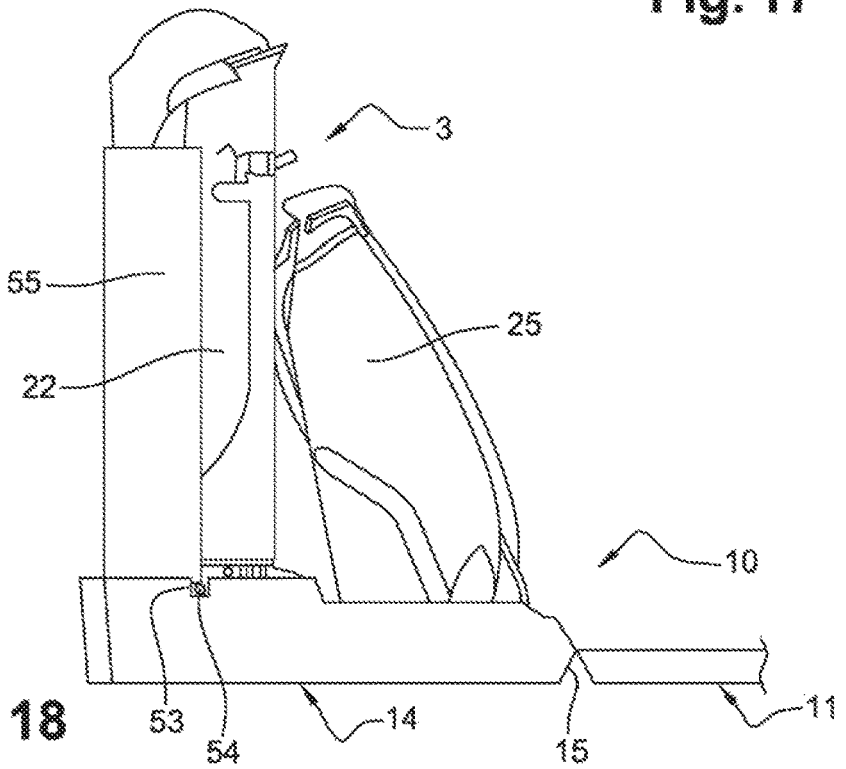
FIGS. 18 to 20 are views illustrating the loading in the box pallet of two coupled seats represented in FIG. 5 and a bench seat represented in FIG. 6, by means of the panel represented in FIGS. 15 to 17.
Figure 19:
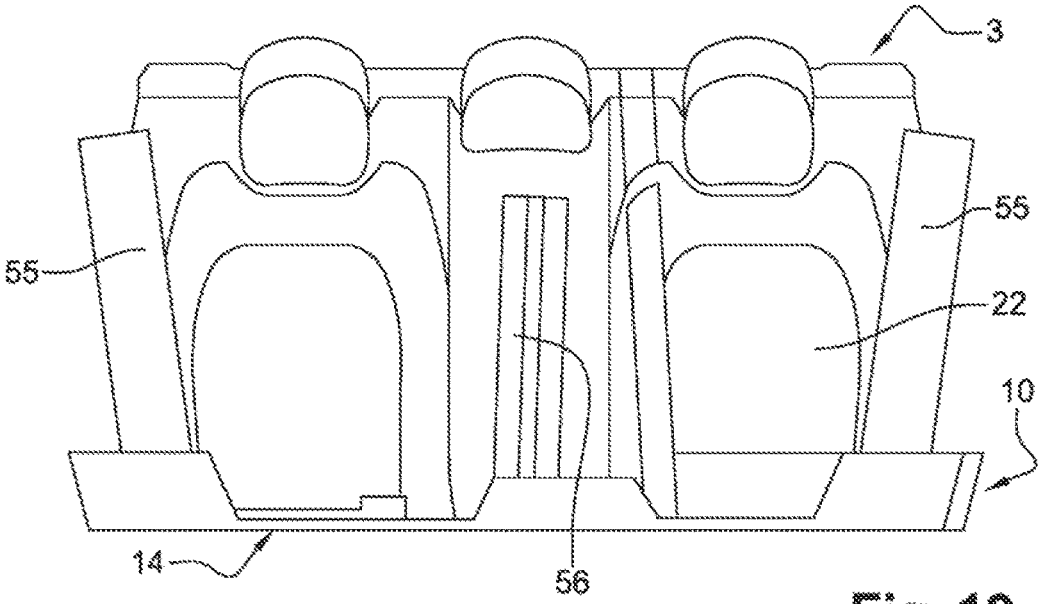
Figure 20:
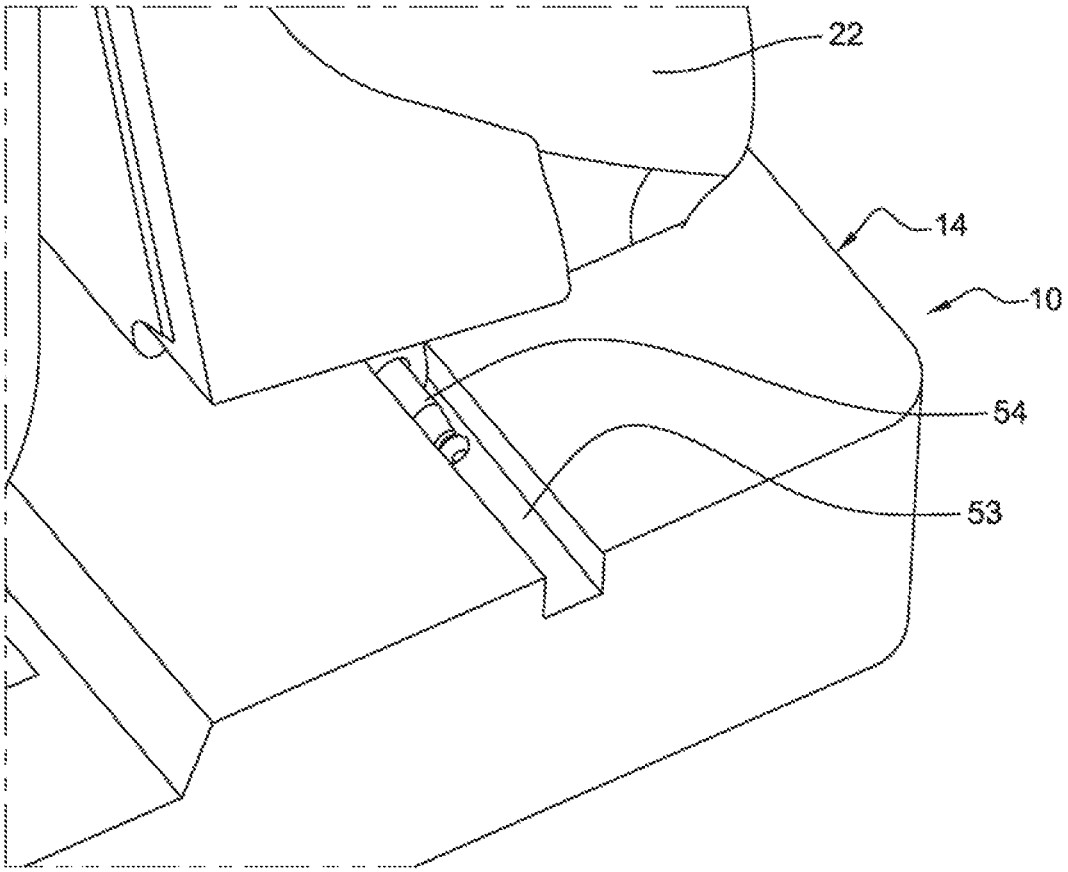

The sole 14 comprises two longitudinal cavities 52, 47, namely a first cavity 52 and a second cavity 47 respectively capable of receiving the backrest 22 and the base 25 of the rear bench seat 3. The first and second cavities 52, 47 communicate via a transversal passage 39, this passage 39 comprising four pins 40, vertically protruding, capable of receiving tabs for securing the backrest 22. The sole 14 further comprises two longitudinal notches 53 and longitudinally bordering the first cavity 52, these notches 53 being capable of receiving axes 54 for articulating the rear bench seat 3. The sole 14 also comprises three arms 55, 56 foldable about (transversal) axes parallel to the base 4, namely two square-shaped side arms 55 and a central arm 56, these arms 55, 56 being capable of holding the backrest 22 of the rear bench seat 3, when the box pallet 1 is in loading configuration (FIGS. 18 and 19). In empty transport configuration (FIG. 16), the arms 55, 56 are folded.

The panel 10 and the arms 55, 56 are for example obtained separately by double skin thermoforming, the arms 55, 56 then being returned on the sole 14. In a variant, the arms 55, 56 can be obtained by cutting then folding a plastic plate.

Figure 21:
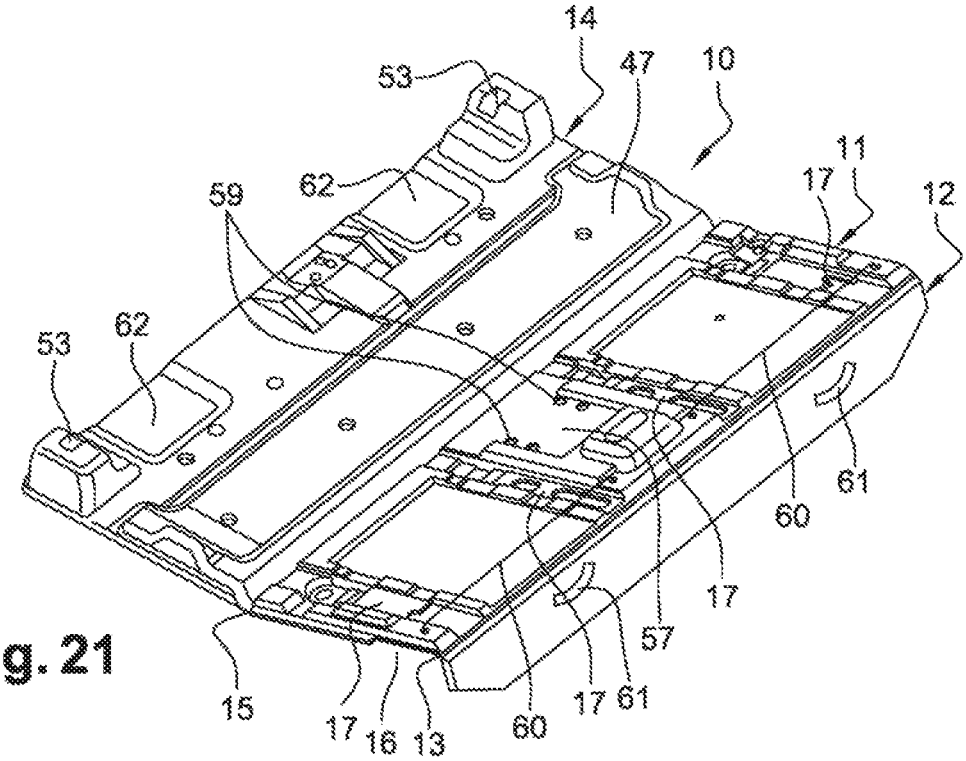
FIG. 21 is a view illustrating an articulated panel capable of forming a wedge for an object to be transported, according to a fifth embodiment.
Figure 22:
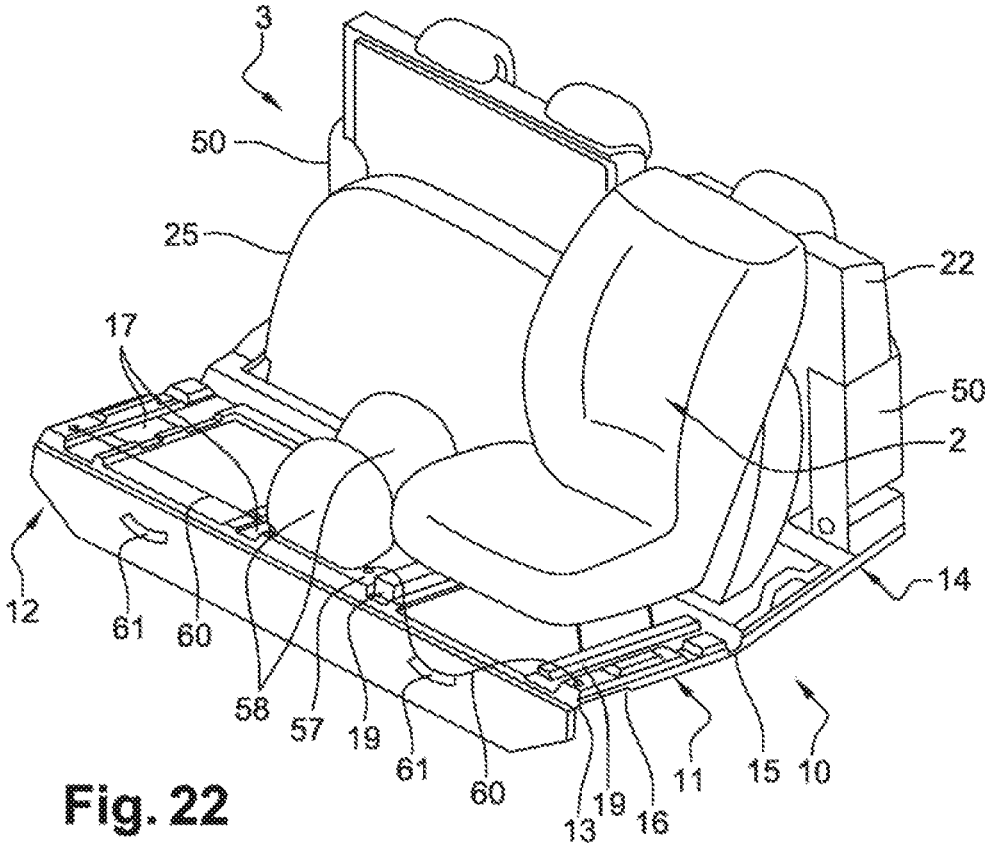
FIG. 22 is a view illustrating the loading in the box pallet of two seats represented in FIG. 5 and of a bench seat represented in FIG. 6, by means of the panel represented in FIG. 21.

According to the fifth embodiment of the panel 10 illustrated in FIGS. 21 and 22, when the flap 12 is in a deployed position (FIGS. 21 and 22), the sole 14 is abutted against a first plate 8*a* (longitudinal) of the belt 5 and the flap 12 is abutted against a second plate 8*b* (longitudinal) of the belt 5, the first plate 8*a* being opposite the second plate 8*b*. When the flap 12 is in a retracted position (not represented), the flap 12 is housed in the reinforcement 16.

The tray 11 comprises a central shelf 57 capable of receiving the two headrests 58 of the two seats 2. More specifically, the shelf 57 comprises, for each of the headrests 58, a pair of holes 59 capable of receiving guiding rods (not visible in the figures).

The panel 10 comprises, for each pair of grooves 17 (or for each seat 2), an elastic (or flexible) connection 60 (immobilisation means 45) secured to each of the ends thereof on the tray 11, on either side of the pair of grooves 17. More specifically, the connection 60 is situated in the proximity of the first folding line 13.

Such as illustrated in FIG. 22, in order to immobilise the seat 2 against the tray 11, the corresponding connection 60 is fastened to the flap 12 by way of a claw 61 formed in the flap 12. From the immobilisation (passage of the connection from an idle position to a loaded position), each slide 19 of the adjustment device 20 is situated vertically between the tray 11 and the connection 60, the connection 60 (via the capacity thereof to be elastically deformed), making it possible to prevent the movement of the seat 2 during the transportation.

The sole 14 comprises two arms 50, foldable about (transversal) axis parallel to the base 4. The arms 50 have, a U-shape section and are facing one another. Such as illustrated in FIG. 22, the arms 50 are capable of immobilising the backrest 22 by integrating the latter between the wings of each arm 50, when the box pallet 1 is in loading configuration. In empty transport configuration, the arms 50 are folded. The arms 50 are not represented in FIG. 21.

The sole 14 further comprises returned pins (not represented), vertically protruding, capable of receiving the tabs for securing the backrest 22. The sole 14 also comprises two recesses 62 capable of being used as abutments to the means for securing (not represented) the backrest 22.

The panel 10 and the arms 50 are, for example, obtained separately by double skin thermoforming, the arms 50 then being returned on the sole 14. In a variant, the arms 50 can be obtained by cutting then folding a plastic plate.

In a variant not represented, holding means 36 are positioned between the tray 11 and the flap 12, such as for example a compass comprising two articulated tie-rods.

The invention claimed is:

1. A box pallet comprising at least one base and one articulated belt, the box pallet being convertible between a loading configuration in which the articulated belt is unfolded and erected on the base so as to form a storage volume and an empty transport configuration in which the articulated belt is folded and laid flat on the base;

further comprising at least one articulated bottom panel that bears on the base and capable of forming a wedge for a bulky object to be loaded into the storage volume, the articulated bottom panel comprises a tray and a flap articulated to with the tray around a first folding line substantially parallel to the base, the flap being movable between a deployed position in which the flap is angled by a predetermined angle with respect to the tray so as to form the wedge for the bulky object and a retracted position in which the flap is co-planar with the tray.

2. The box pallet according to claim 1, wherein the articulated bottom panel is articulated around a folding line substantially parallel to the base.

3. The box pallet according to claim 2, wherein the first folding line is formed by local compression of material of the articulated bottom panel, a thinning of a thickness of the articulated bottom panel, or both.

4. The box pallet according to claim 1, wherein the flap is housed in a recess of the tray when the flap is in the retracted position.

5. The box pallet according to claim 1, wherein the articulated bottom panel comprises a sole articulated to the tray around a second folding line substantially parallel to the base and opposite to the flap, the sole abutting against a first plate of the articulated belt and the flap abutting against a second plate of the articulated belt when the flap is in the deployed position, the first plate being opposite the second plate.

6. The box pallet according to claim 1, wherein the articulated bottom panel comprises at least one wedging wall articulated with respect to the tray or returned on the tray.

7. The box pallet according to claim 1, wherein the articulated bottom panel comprises at least one arm mobile in rotation about an axis substantially parallel to the base.

8. The box pallet according to claim 1, further comprising a cover.

9. The box pallet according to claim 1, wherein the panel further comprises a wall articulated to the sole around a third folding line substantially parallel to the base, and holding means for holding the wall in a loading configuration, the holding means comprising two shrouds longitudinally bordering the panel, each shroud being secured to an upper portion of the wall and to an upper portion of the sole.

* * * * *